US010471307B2

(12) United States Patent
Madson et al.

(10) Patent No.: US 10,471,307 B2
(45) Date of Patent: Nov. 12, 2019

(54) GOLF BALL DIMPLE PATTERNS CONTRIBUTING TO A NON-STRAIGHT FLIGHT TRAJECTORY

(71) Applicant: Acushnet Company, Fairhaven, MA (US)

(72) Inventors: Michael R. Madson, Easton, MA (US); Nicholas M. Nardacci, Barrington, RI (US); William E. Morgan, Rehoboth, MA (US); Matthew F. Hogge, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/497,513

(22) Filed: Apr. 26, 2017

(65) Prior Publication Data

US 2018/0311532 A1 Nov. 1, 2018

(51) Int. Cl.
*A63B 37/00* (2006.01)
*A63B 37/14* (2006.01)

(52) U.S. Cl.
CPC ..... *A63B 37/0006* (2013.01); *A63B 37/0012* (2013.01); *A63B 37/0077* (2013.01); *A63B 37/0089* (2013.01); *A63B 37/002* (2013.01); *A63B 37/0016* (2013.01)

(58) Field of Classification Search
CPC ..... A63B 37/0004; A63B 37/0006; A63B 37/0012; A63B 37/0016; A63B 37/0019
See application file for complete search history.

(56) References Cited

U.S. PATENT DOCUMENTS 5,482,287 A * 1/1996 Nesbitt ..... A63B 37/0004 473/378
2005/0032590 A1* 2/2005 Kasashima ..... A63B 37/0004 473/378

* cited by examiner

*Primary Examiner* — John E Simms, Jr.
(74) *Attorney, Agent, or Firm* — Mandi B. Milbank

(57) ABSTRACT

The present invention provides golf balls having a non-straight flight trajectory due, at least in part, to a dimple pattern wherein the dimples on the opposing sides of the ball have at least one design feature that is different.

8 Claims, 2 Drawing Sheets

GOLF BALL DIMPLE PATTERNS CONTRIBUTING TO A NON-STRAIGHT FLIGHT TRAJECTORY

FIELD OF THE INVENTION

This invention relates to golf balls having dimple design features that contribute to a non-straight flight trajectory when the ball is hit in a preferred orientation.

BACKGROUND OF THE INVENTION

Golf balls must meet certain standards in order to be included on the official Conforming Golf Balls List (the "List") produced by the United States Golf Association and The Royal and Ancient Golf Club of St. Andrews, Scotland, the two ruling bodies for the game of golf. Inclusion on the List is a requirement for use in competitive golf, and most serious players, including recreational golfers, won't use a ball unless it appears on the List.

One of the standards, commonly referred to as the "Symmetry Rule," specifies that a ball must fly essentially the same distance and for essentially the same amount of time regardless of how it is oriented when struck by the golf club. Thus, golf ball manufacturers generally pursue dimple patterns that provide a ball with symmetrical aerodynamic properties regardless of orientation. In dimple patterns resulting in conforming aerodynamic properties, the dimples on one side of the mold parting line typically have the same design features (i.e., dimple diameter, plan shape, profile shape, edge angle, placement of the dimple within the overall pattern, etc.) as the dimples on the other side of the mold parting line. However, dimple patterns resulting in conforming aerodynamic properties have also been disclosed wherein at least some of the dimples on one side of the mold parting line have a different design feature than those on the other side of the mold parting line. For example, U.S. patent application Ser. No. 14/985,743 to Madson, et al., filed on Dec. 31, 2015, discloses dimple patterns that achieve flight symmetry despite the use of different dimple geometries on the opposing hemispheres due to equivalent dimple volume ratio between opposing hemispheres.

In spite of the Symmetry Rule, golf balls having non-conforming aerodynamic properties have been disclosed and are commercially available. The primary objective of such balls is typically to reduce the effect of hits by unskilled golfers (e.g., hooks and slices) in order for the ball to fly more consistently along a straighter path. For example, the Polara ball, further described in U.S. Pat. No. 3,819,190 to Nepela et al., is a non-conforming ball that allegedly corrects any natural slice or hook through the use of enlarged, shallower dimples along the y-axis and smaller, deeper dimples along the x-axis. Golf balls having non-conforming aerodynamic properties have also been disclosed, for example, in U.S. Patent Application Publication No. 2013/0090189 to Felker et al., which is directed to a non-conforming golf ball having a dimple pattern which causes the ball to have a preferred spin axis because of the weight differences caused by locating different volume dimples in different areas across the ball. This, in turn, allegedly reduces the tendency for the ball to hook or slice during flight.

In contrast to the above golf balls, an object of the present invention is to provide a golf ball with a non-straight flight trajectory when the ball is hit in a particular orientation with respect to the dimple pattern. The non-straight flight trajectory is, at least in part, the result of a novel dimple pattern wherein the dimples on the outer surface of one side of the ball have at least one design feature that is different from the dimples on the outer surface of the other side of the ball.

SUMMARY OF THE INVENTION

The present invention is directed to a golf ball having a plurality of dimples on the outer surface thereof. The outer surface can be divided by a dividing plane that passes through the geometric center of the golf ball and divides the outer surface into a first side and a second side. The ball has a non-straight flight trajectory as shown by an absolute transverse coefficient of greater than 0.013 at a Reynolds Number of 226300 and a spin ratio of 0.124, an absolute transverse coefficient of greater than 0.023 at a Reynolds Number of 143500 and a spin ratio of 0.151, and an absolute transverse coefficient of greater than 0.043 at a Reynolds Number of 74500 and a spin ratio of 0.207, when oriented such that the ball axis of rotation is normal to the dividing plane. In one embodiment, a majority of the dimples on the first side are spherical dimples, a majority of the dimples on the second side are spherical dimples, and the average edge angle of the spherical dimples on the first side is at least 1° greater than the average edge angle of the spherical dimples on the second side. In another embodiment, the difference between the average dimple volume of the dimples of the first side ($DV_{S1}$) and the average dimple volume of the dimples of the second side ($DV_{S2}$) is greater than $7.30\times10^{-6}$ $in^3$. In another embodiment, the dimple arrangement on the first side is different from the dimple arrangement on the second side.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

The present invention is directed to golf balls having a non-straight flight trajectory due, at least in part, to the dimples on opposing sides of the ball differing in at least one design feature. For purposes of the present disclosure, "opposing sides" of the ball are defined by a dividing plane that passes through the geometric center of the golf ball and divides the outer surface into a first side and a second side. The dividing plane may be, but is not necessarily, equivalent to the plane that is considered by those of ordinary skill in the art to be the equator of the ball.

Suitable dimple design features that differ on opposing sides of the ball include, but are not limited to, one or more of: average edge angle, average dimple volume, dimple arrangement, and dimple count. For purposes of the present disclosure, edge angle and diameter measurements are determined on finished golf balls according to FIG. 1. Generally, it may be difficult to measure certain dimple properties, such as edge angle and diameter, due to the indistinct nature of the boundary dividing the dimple from the ball's undisturbed land surface. Due to the effect of paint and/or the dimple design itself, the junction between the land surface and dimple may not be a sharp corner and is therefore indistinct.

Figure 1:
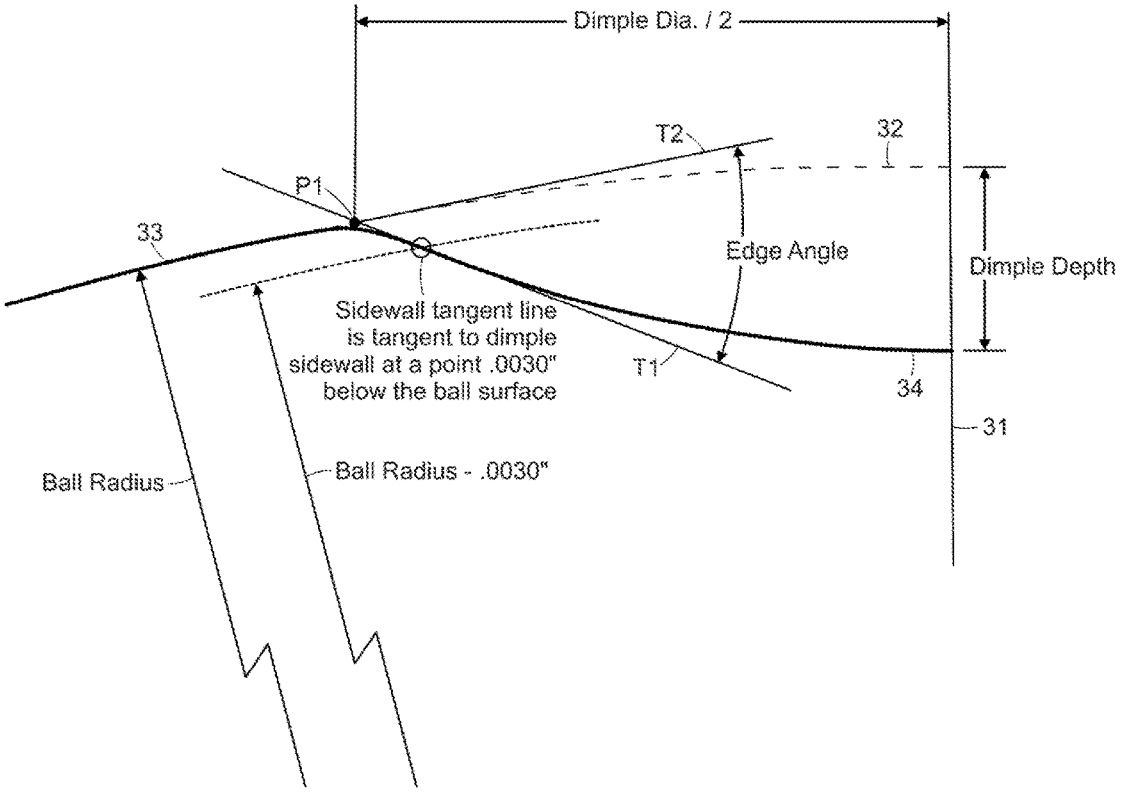
FIG. 1 is a schematic diagram illustrating a method for measuring the diameter of a dimple.

This can make the measurement of a dimple's edge angle and diameter somewhat ambiguous. To resolve this problem, the edge angle and diameter of a dimple on a finished golf ball is measured according to the method shown in FIG. 1. FIG. 1 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface). For purposes of the present disclosure, edge angles on a finished ball are substantially the same if they differ by less than 0.25°.

In one embodiment, opposing sides of the ball have differing average edge angles. In this embodiment, each of the two sides of the ball comprises a plurality of dimples, and, preferably, a majority of the dimples on each of the two sides of the ball are spherical dimples, i.e., having a circular plan shape and a profile shape based on a spherical function. The average edge angle of the spherical dimples on one side is at least 1° greater than, or at least 2° greater than, or at least 3° greater than, the average edge angle of the spherical dimples on the other side. In a particular aspect of this embodiment, for each of the two sides of the ball, the edge angle of each spherical dimple on a particular side is substantially the same as the other spherical dimples on that side. In another particular aspect of this embodiment, on one side of the ball the edge angles of the spherical dimples on that side are substantially the same, but on the other side of the ball, the edge angle of at least one spherical dimple is not substantially the same as the average edge angle of the spherical dimples on that side. In another particular aspect of this embodiment, for each of the two sides of the ball, the edge angle of at least one spherical dimple is not substantially the same as the average edge angle of the spherical dimples on that side. The dimples on opposing sides of the ball optionally have the same arrangement, wherein for each dimple having a centroid located at a particular position within the dimple pattern on one side of the ball, there is a corresponding dimple having a centroid located in substantially the same position within the dimple pattern on the other side of the ball. In a particular aspect of embodiments wherein dimples on opposing sides of the ball have the same arrangement, each dimple on one side of the ball has substantially the same diameter as its corresponding dimple on the other side of the ball, i.e., the diameters of corresponding dimples differ by less than 0.005 inches due to manufacturing variances.

In another embodiment, opposing sides of the ball have differing average dimple volumes. In this embodiment, the difference between the average dimple volume of the dimples on one side ($DV_{S1}$) and the average dimple volume of the dimples on the other side ($DV_{S2}$) is preferably greater than $7.30\times10^{-6}$ in$^3$, or greater than $1.30\times10^{-5}$ in$^3$, or greater than $2.10\times10^{-5}$ in$^3$. In a particular aspect of this embodiment, each of the two sides of the ball comprises a plurality of dimples, and a majority of the dimples on each of the two sides of the ball have a circular plan shape. In another particular aspect of this embodiment, each of the two sides of the ball comprises a plurality of dimples, a majority of the dimples on one side of the ball have a circular plan shape, and a majority of the dimples on the other side of the ball have a non-circular plan shape. In another particular aspect of this embodiment, each of the two sides of the ball comprises a plurality of dimples, and a majority of the dimples on each of the two sides of the ball have a non-circular plan shape. Examples of suitable non-circular plan shapes include, but are not limited to, elliptical, oval, petal, heart, star, dewdrop, and polygonal shapes, such as triangular, quadrilateral, and hexagonal. The dimples on opposing sides of the ball optionally have the same arrangement, wherein for each dimple having a centroid located at a particular position within the dimple pattern on one side of the ball, there is a corresponding dimple having a centroid located in substantially the same position within the dimple pattern on the other side of the ball. In a particular aspect of embodiments wherein dimples on opposing sides of the ball have the same arrangement, each dimple on one side of the ball has a different plan shape and/or different diameter than its corresponding dimple on the other side of the ball.

In another embodiment, opposing sides of the ball have differing dimple arrangements. The dimple arrangement on opposing sides of the ball is different if at least one dimple having a centroid located at a particular position within the dimple pattern on one side does not have a corresponding dimple having a centroid located in substantially the same position within the dimple pattern on the other side. One of ordinary skill in the art can readily determine the difference between (a) differing dimple arrangements wherein the dimples on one side have no corresponding dimple on the other side and (b) substantially identical dimple arrangements wherein the location of geometric centers of corresponding dimples may differ slightly due to manufacturing variances. In a particular aspect of this embodiment, the dimple count on one side of the ball is the same as the dimple count on the other side of the ball. In another particular aspect of this embodiment, the dimple count on one side of the ball is different from the dimple count on the other side of the ball. In a further particular aspect of this embodiment, the dimple count on one side of the ball is zero.

Figure 2:
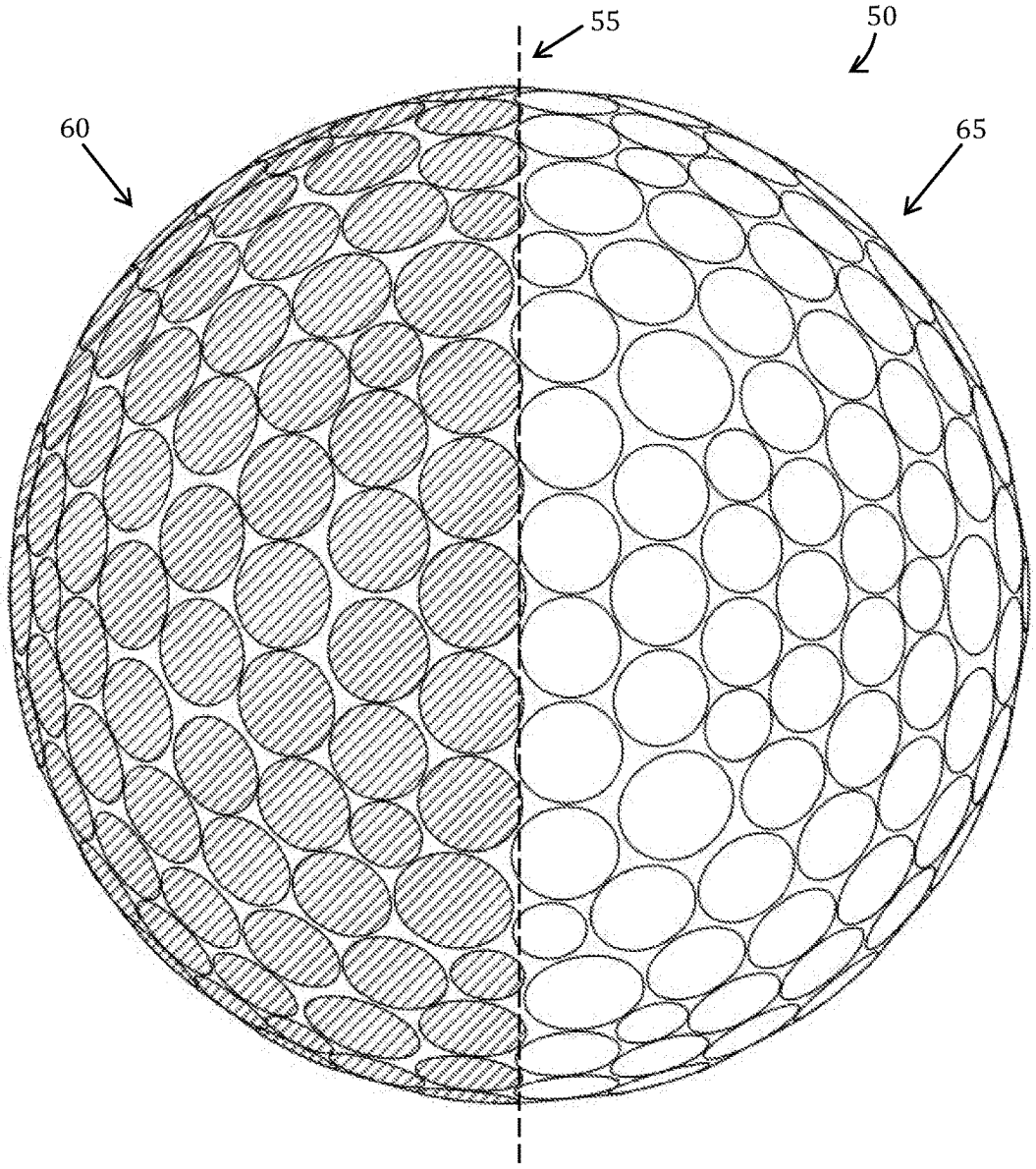
FIG. 2 illustrates a golf ball having a dimple pattern according to an embodiment of the present invention.

An example of a golf ball according to the present invention is illustrated in FIG. 2, which shows a golf ball 50 wherein a dividing plane 55 divides the outer surface of the ball into a first side 60 and a second side 65. The shaded dimples represent the dimples of the first side 60, and the unshaded dimples represent the dimples of the second side 65. The dimples of the first side 60 have the same arrangement as the dimples of the second side 65. Thus, for every dimple on the first side 60, there is a corresponding dimple on the second side 65 positioned such that the locations of the geometric centers of the corresponding dimples are substantially identical within the dimple pattern of their respective side of the ball. In the embodiment illustrated in FIG. 2, the total number of dimples on the outer surface of the ball is 328, the total number of different dimple diameters on the outer surface is 7, and corresponding dimples have substantially the same diameter, i.e., their diameters differ by less than 0.005 inches due to manufacturing variances.

In one particular aspect of the embodiment illustrated in FIG. 2, all of the dimples of the first side 60 are spherical dimples having the same edge angle, and all of the dimples of the second side 65 are spherical dimples having the same edge angle, but the edge angle of the dimples of the first side is different from the edge angle of the dimples of the second side 65. In a further particular aspect of this embodiment, the dimple diameters and edge angles are as given in Table 1 below.

TABLE 1

| Dimple Diameter (in) | First Side Edge Angle | Second Side Edge Angle |
|---|---|---|
| 0.123 | 15.0° | 12.0° |
| 0.148 | 15.0° | 12.0° |
| 0.163 | 15.0° | 12.0° |
| 0.168 | 15.0° | 12.0° |
| 0.173 | 15.0° | 12.0° |
| 0.178 | 15.0° | 12.0° |
| 0.198 | 15.0° | 12.0° |

In another particular aspect of the embodiment illustrated in FIG. 2, corresponding dimples have different dimple volumes, and the average dimple volume of the dimples of the first side 60 is different from the average dimple volume of the dimples of the second side 65. All of the dimples on the outer surface of the ball have a circular plan shape and a profile shape based on a non-spherical function. In a further particular aspect of this embodiment, the dimple diameters are as given in Table 2 below. For each different dimple diameter, Table 2 also gives a preferred number on each side of the ball of dimples having that diameter, as well as the dimple volume for each dimple of the first side having that diameter and the dimple volume for each dimple of the second side having that diameter, according to one embodiment of the present invention. The average dimple volume for the first side and the second side is also given in Table 2.

TABLE 2

| Dimple Diameter (in) | Dimples per Side | First Side Dimple Volume ($in^3$) | Second Side Dimple Volume ($in^3$) |
|---|---|---|---|
| 0.123 | 18 | $4.805 \times 10^{-5}$ | $3.835 \times 10^{-5}$ |
| 0.148 | 14 | $8.364 \times 10^{-5}$ | $6.679 \times 10^{-5}$ |
| 0.163 | 12 | $1.117 \times 10^{-4}$ | $8.921 \times 10^{-5}$ |
| 0.168 | 30 | $1.223 \times 10^{-4}$ | $9.768 \times 10^{-5}$ |
| 0.173 | 36 | $1.335 \times 10^{-4}$ | $1.067 \times 10^{-4}$ |
| 0.178 | 42 | $1.454 \times 10^{-4}$ | $1.162 \times 10^{-4}$ |
| 0.198 | 12 | $2.001 \times 10^{-4}$ | $1.599 \times 10^{-4}$ |

First Side Average Dimple Volume: $1.241 \times 10^{-4}$ $in^3$
Second Side Average Dimple Volume: $9.919 \times 10^{-5}$ $in^3$ Dimple patterns of the present invention contribute to the non-straight flight trajectory of the golf ball, as shown by the transverse coefficient of the ball when oriented such that the ball axis of rotation is normal to the dividing plane that defines the opposing sides of the ball. In one embodiment, golf balls of the present invention have an absolute transverse coefficient of:

greater than 0.013 at a Reynolds Number of 226300 and a spin ratio of 0.124, greater than 0.023 at a Reynolds Number of 143500 and a spin ratio of 0.151, and greater than 0.043 at a Reynolds Number of 74500 and a spin ratio of 0.207, when oriented such that the ball axis of rotation is normal to the dividing plane that defines the opposing sides of the ball. In another embodiment, golf balls of the present invention have an absolute transverse coefficient of:

greater than 0.027 at a Reynolds Number of 226300 and a spin ratio of 0.124;

greater than 0.045 at a Reynolds Number of 143500 and a spin ratio of 0.151; and greater than 0.086 at a Reynolds Number of 74500 and a spin ratio of 0.207, when oriented such that the ball axis of rotation is normal to the dividing plane that defines the opposing sides of the ball. In another embodiment, golf balls of the present invention have an absolute transverse coefficient of:

greater than 0.048 at a Reynolds Number of 226300 and a spin ratio of 0.124;

greater than 0.068 at a Reynolds Number of 143500 and a spin ratio of 0.151; and greater than 0.129 at a Reynolds Number of 74500 and a spin ratio of 0.207, when oriented such that the ball axis of rotation is normal to the dividing plane that defines the opposing sides of the ball.

Conventional golf balls generally have an absolute transverse coefficient of less than 0.010 at any given Reynolds Number and spin ratio, regardless of the orientation of the ball in flight.

For purposes of the present invention, transverse coefficient is determined by testing a minimum of twelve golf balls in a photogrammetric indoor testing range. The transverse coefficient for each ball is calculated at several different Reynolds Numbers and spin ratios. The non-straight flight trajectory of the ball can be in either direction, and, thus, the transverse coefficient is recorded as an absolute value. For each Reynolds Number and spin ratio tested, the average of the results for the tested balls is recorded as the absolute transverse coefficient. The Reynolds number is an average value for the test and can vary by ±3%. The spin ratio is an average value for the test and can vary by ±5%.

While golf balls of the present invention are not limited to a particular dimple count, in a particular embodiment, the golf ball has a dimple count of 252 or 272 or 300 or 302 or 306 or 310 or 312 or 316 or 318 or 320 or 328 or 332 or 336 or 338 or 342 or 344 or 346 or 348 or 350 or 352 or 354 or 358 or 360 or 362 or 366 or 372 or 376 or 384 or 388 or 390 or 392 or 432 or 492.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples on the outer surface thereof, wherein the outer surface can be divided by a dividing plane that passes through the geometric center of the golf ball and divides the outer surface into a first side and a second side having the following properties:

the first side consists of spherical dimples having the same edge angle, ($EA_{S1}$), the second side consists of spherical dimples having the same edge angle, ($EA_{S2}$), and the edge angle of the spherical dimples of the first side ($EA_{S1}$) is at least 1° greater than the edge angle of the spherical dimples of the second side ($EA_{S2}$).

2. The golf ball of claim 1, wherein the dimples of the first side and the dimples of the second side have the same arrangement such that for each dimple having a centroid located at a particular position within the dimple pattern of the first side there is a corresponding dimple having a centroid located in substantially the same position within the dimple pattern of the second side.

3. The golf ball of claim 2, wherein each dimple of the first side has substantially the same diameter as its corresponding dimple of the second side.

4. The golf ball of claim 1, wherein $EA_{S1}$ is at least 2° greater than $EA_{S2}$.

5. The golf ball of claim 1, wherein $EA_{S1}$ is at least 3° greater than $EA_{S2}$.

6. The golf ball of claim 1, wherein the difference between the average dimple volume of the dimples of the first side ($DV_{S1}$) and the average dimple volume of the dimples of the second side ($DV_{S2}$) is greater than $7.30\times10^{-6}$ $in^3$.

7. The golf ball of claim 1, wherein the difference between the average dimple volume of the dimples of the first side ($DV_{S1}$) and the average dimple volume of the dimples of the second side ($DV_{S2}$) is greater than $1.30\times10^{-5}$ $in^3$.

8. The golf ball of claim 1, wherein the difference between the average dimple volume of the dimples of the first side ($DV_{S1}$) and the average dimple volume of the dimples of the second side ($DV_{S2}$) is greater than $2.10\times10^{-5}$ $in^3$.

* * * * *